US009535376B2

(12) United States Patent
Sone et al.

(10) Patent No.: US 9,535,376 B2
(45) Date of Patent: Jan. 3, 2017

(54) IMAGE FORMING APPARATUS THAT SWITCHES TRANSFER BIAS BASED ON DETECTED ENVIRONMENT CONDITION

(71) Applicants: Keita Sone, Tokyo (JP); Shinichi Akatsu, Kanagawa (JP); Tomohide Takenaka, Kanagawa (JP); Tetsuya Muto, Tokyo (JP); Akira Yoshida, Tokyo (JP); Keita Gotoh, Kanagawa (JP); Yuuichiroh Uematsu, Kanagawa (JP)

(72) Inventors: Keita Sone, Tokyo (JP); Shinichi Akatsu, Kanagawa (JP); Tomohide Takenaka, Kanagawa (JP); Tetsuya Muto, Tokyo (JP); Akira Yoshida, Tokyo (JP); Keita Gotoh, Kanagawa (JP); Yuuichiroh Uematsu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/044,596

(22) Filed: Feb. 16, 2016

(65) Prior Publication Data

US 2016/0246220 A1 Aug. 25, 2016

(30) Foreign Application Priority Data

Feb. 24, 2015 (JP) ..... 2015-034075

(51) Int. Cl.
*G03G 15/00* (2006.01)
*G03G 15/16* (2006.01)
*G03G 21/20* (2006.01)

(52) U.S. Cl.
CPC ..... *G03G 15/1665* (2013.01); *G03G 21/20* (2013.01)

(58) Field of Classification Search
CPC ..... G03G 15/1665; G03G 15/167; G03G 15/1675; G03G 21/20
(Continued)

(56) References Cited

U.S. PATENT DOCUMENTS

2004/0253012 A1 12/2004 Ishibashi
2012/0045259 A1 2/2012 Nakamura et al.
(Continued)

FOREIGN PATENT DOCUMENTS

JP 2004-279664 10/2004
JP 2006-139180 6/2006
(Continued)

OTHER PUBLICATIONS

U.S. Appl. No. 14/881,611, filed Oct. 13, 2015.

*Primary Examiner* — Sophia S Chen
(74) *Attorney, Agent, or Firm* — Oblon, McClelland, Maier & Neustadt, L.L.P.

(57) ABSTRACT

An image forming apparatus includes an image bearing belt of a multi-layer structure, a toner image forming device, a nip forming device, a transfer power source, an environment-condition detector, and a controller. The toner image forming device forms a toner image on a surface of the image bearing belt. The transfer power source outputs a transfer bias including a superimposed voltage, in which a direct current voltage is superimposed on an alternating current voltage to transfer the toner image from the image bearing belt onto a recording medium at a transfer nip. The environment-condition detector detects an environment condition. The controller controls the transfer bias output from the transfer power source to perform a bias switching process to switch the transfer bias between a transfer bias including the superimposed voltage and a transfer bias
(Continued)

including a direct current voltage based on a detected result of the environment-condition detector.

9 Claims, 6 Drawing Sheets

(58) Field of Classification Search
USPC ..... 399/66, 44, 49
See application file for complete search history.

(56) References Cited

U.S. PATENT DOCUMENTS

| | | | | |
|---|---|---|---|---|
| 2013/0308968 | A1* | 11/2013 | Tanaka | G03G 15/1665 399/44 |
| 2014/0328604 | A1* | 11/2014 | Tanaka | G03G 15/1675 399/66 |
| 2016/0161887 | A1* | 6/2016 | Sugiura | G03G 21/20 399/66 |
| 2016/0161888 | A1* | 6/2016 | Wada | G03G 15/1665 399/66 |
| 2016/0187845 | A1* | 6/2016 | Deguchi | G03G 15/1665 399/66 |

FOREIGN PATENT DOCUMENTS

| | | |
|---|---|---|
| JP | 2012-063746 | 3/2012 |
| JP | 2013-182153 | 9/2013 |
| JP | 2014-010383 | 1/2014 |

* cited by examiner

IMAGE FORMING APPARATUS THAT SWITCHES TRANSFER BIAS BASED ON DETECTED ENVIRONMENT CONDITION

CROSS-REFERENCE TO RELATED APPLICATION

This patent application is based on and claims priority pursuant to 35 U.S.C. §119(a) to Japanese Patent Application No. 2015-034075, filed on Feb. 24, 2015, in the Japan Patent Office, the entire disclosure of which is hereby incorporated by reference herein.

BACKGROUND

Technical Field

Exemplary aspects of the present invention generally relates to an image forming apparatus.

Related Art

An image forming apparatus, such as a copier, a facsimile machine, a printer, or a multi-functional system including a combination thereof, may include a power source that outputs a superimposed bias in which a direct current (DC) voltage is superimposed on an alternating current (AC) voltage.

In the image forming apparatus, for example, an intermediate transfer belt including soft elastic layers on a base layer is used as an image bearer. The intermediate transfer belt contacts a nip formation roller to form a transfer nip, in which a toner image is transferred from the intermediate transfer belt onto a recording medium. During this time, a power source in the image forming apparatus outputs a transfer bias, in which a direct current voltage is superimposed on an alternating current voltage, to a transfer back-surface roller entraining the intermediate transfer belt, from the backside of the intermediate transfer belt. With this configuration, the toner image can be successfully transferred from the intermediate transfer belt onto paper having an uneven surface, such as Japanese paper called "Washi".

SUMMARY

In an aspect of this disclosure, there is provided an image forming apparatus including an image bearing belt of a multi-layer structure, a toner image forming device, a nip forming device a transfer power source, an environment-condition detector, and a controller. The toner image forming device forms a toner image on a surface of the image bearing belt. The nip forming device is disposed in contact with the image bearing belt to form a transfer nip between the nip forming device and the image bearing belt. The transfer power source outputs a transfer bias including a superimposed voltage, in which a direct current voltage is superimposed on an alternating current voltage to transfer the toner image from the image bearing belt onto a recording medium at a transfer nip. The environment-condition detector detects an environment condition. The controller controls the transfer bias output from the transfer power source to perform a bias switching process to switch the transfer bias between a transfer bias including the superimposed voltage and a transfer bias including a direct current voltage based on a detected result of the environment-condition detector.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
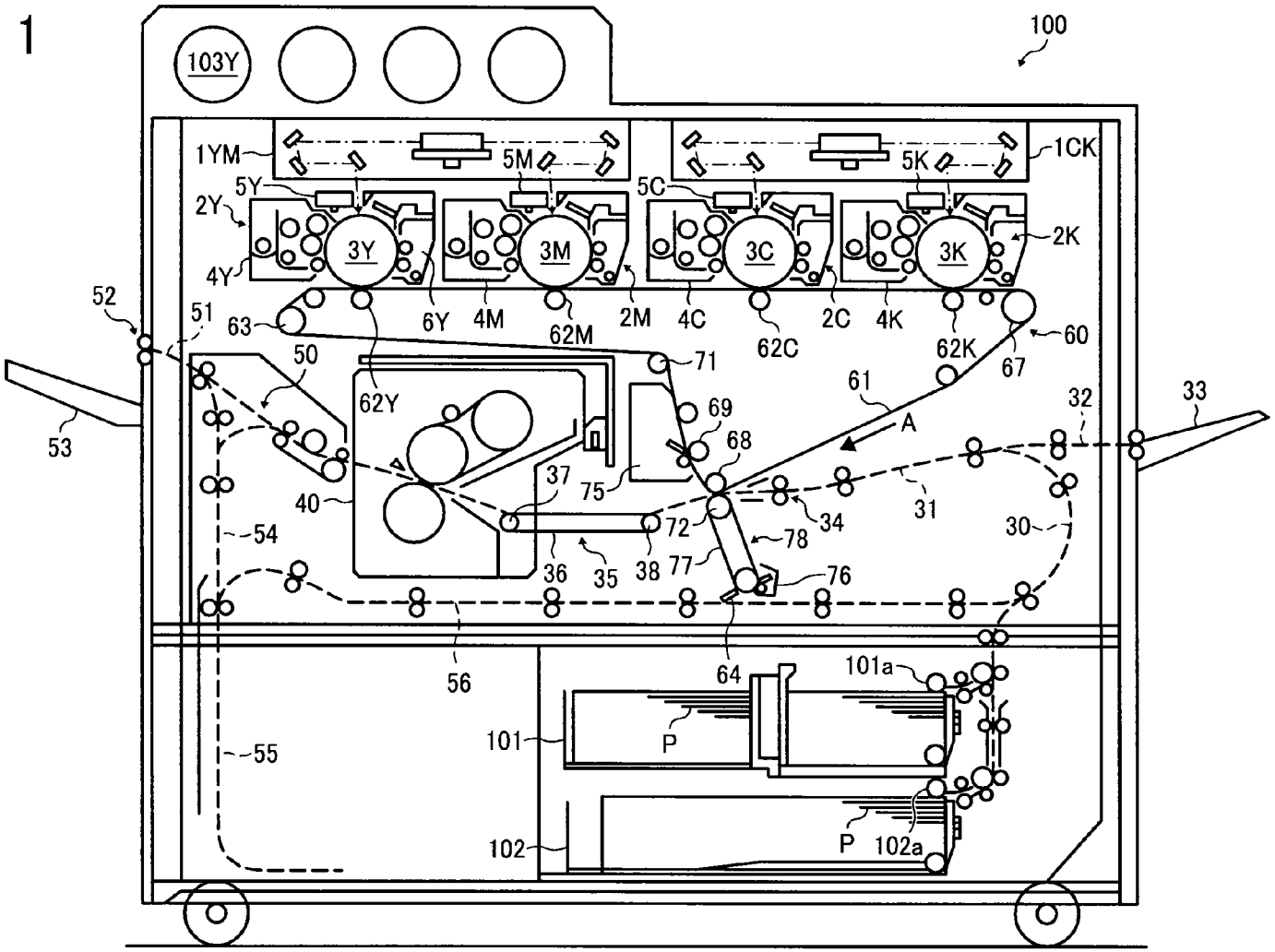
FIG. 1 is a schematic view of a printer as an example of an image forming apparatus, according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

A description is provided of an electrophotographic color printer as an example of an image forming apparatus according to an embodiment of the present disclosure.

FIG. 1 is a schematic view of the image forming apparatus 100. As illustrated in FIG. 1, the image forming apparatus 100 includes four image forming units 2Y, 2M, 2C, and 2K for forming toner images, one for each of the colors yellow, magenta, cyan, and black, respectively. It is to be noted that the suffixes Y, M, C, and K denote colors yellow, magenta, cyan, and black, respectively. To simplify the description, the suffixes Y, M, C, and K indicating colors may be omitted herein, unless differentiation of colors is necessary. The four image forming units 2Y, 2M, 2C, 2K are arranged in tandem along a direction of endless movement of an intermediate transfer belt 61 as an image bearing belt to be described below.

The image forming apparatus 100 further includes a sheet feeding path 30, a pre-transfer conveyance path 31, a manual sheet feeding path 32, a bypass tray 33, registration rollers 34, a conveyor belt unit 35, a fixing device 40, a conveyance path switching device 50, a sheet ejection path 51, an output roller pair 52, and an output tray 53. The image forming apparatus also includes two optical writing units 1YM and 1CK, a primary transfer unit 60, a secondary transfer unit 78, a first sheet tray 101, and a second sheet tray 102.

The image forming units 2Y, 2M, 2C, and 2K respectively include drum-shaped photoconductors 3Y, 3M, 3C, and 3K as latent image bearers. The first sheet tray 101 and the second sheet tray 102 each stores a bundle of recording sheets P as recording media therewithin. The feeding rollers 101*a* and 102*a* rotate to deliver the top sheet of the bundle of the recording sheets P to the sheet feeding path 30.

The bypass tray 33, which is disposed on a side of an apparatus housing, is openable relative to the apparatus housing. With the bypass tray 33 open, the bundle of recording sheets P is manually placed on the upside of the bypass tray 33. The top sheet of the bundle of the recording sheets P on the bypass tray 33 is then sent to the sheet feeding path 30.

The optical writing units 1YM and 1CK respectively include laser diodes, polygon mirrors, and mirrors. Based on image data obtained by a scanner disposed outside of the image forming apparatus 100 or sent from an external device, such as a personal computer (PC), the optical writing units 1YM and 1CK cause the laser diodes to irradiate the photoconductors 3Y, 3M, 3C, and 3K of the image forming units 2Y, 2M, 2C, and 2K with laser beams. In particular, the photoconductors 3Y, 3M, 3C, and 3K of the image forming units 2Y, 2M, 2C, and 2K are driven to rotate in a counter-clockwise direction indicated by arrow A in FIG. 1. The optical writing unit 1YM irradiates the photoconductors 3Y and 3M, which are rotating, with laser beams deflected along the respective rotational axis direction. Through such an optical scanning process, electrostatic latent images for yellow and magenta are respectively formed on the photoconductors 3Y and 3M based on image data for yellow and magenta. The optical writing unit 1CK irradiates the photoconductors 3C and 3K, which are rotating, with laser beams deflected along the respective rotational axis direction. Through such an optical scanning process, electrostatic latent images for cyan and black are respectively formed on the photoconductors 3C and 3K based on image data for cyan and black.

The image forming units 2Y, 2M, 2C, and 2K respectively include the photoconductors 3Y, 3M, 3C, and 3K as latent image bearers, and various devices disposed around the circumferences of the respective image forming units 2Y, 2M, 2C, and 2K. Each image forming unit including the above-described components is removably supported on the corresponding support in an integrated manner respective to the apparatus housing. The image forming units 2Y, 2M, 2C, and 2K have the same configuration, except for different colors of toner employed. Taking the image forming unit for yellow 2Y as an example, the image forming unit 2Y includes the photoconductor 3Y and an developing device 4Y to develop an electrostatic latent image from the photoconductor 3Y to a Y toner image. The image forming apparatus further includes a charging device 5Y and a drum cleaning device 6Y. The charging device 5Y uniformly charges the surface of the photoconductor 3Y driven to rotate. The drum cleaning device 6Y removes residual toner remaining on the surface of the photoconductor 3Y having passed a primary transfer nip for yellow to be described later.

The photoconductor 3Y is a drum-shaped photoconductor including a base tube made of aluminum, which has photosensitive layers formed by applying organic photosensitive materials with photoconductivity. Alternatively, in some embodiments, the photoconductor 3Y is of an endless looped belt shape, instead of the drum-shaped photoconductor.

The developing device 4Y includes a cylindrical developing sleeve made of a non-magnetic pipe which is rotated, and a magnetic roller disposed inside the developing sleeve. The developing device 4Y employs two-component developer including magnetic carrier and non-magnetic toner (hereinafter simply "developer") to develop the latent image on the photoconductor 3Y. In this case, a developing potential works on the Y toner on the developing sleeve, opposed to the electrostatic latent image. This is caused by a potential difference between the developing bias applied to the developing sleeve and the electrostatic latent image on the photoconductor 3Y. At this time, a potential difference between the developing bias and the background portion (non-image formation area) of the photoconductor 3Y causes a background potential to work on the Y toner on the developing sleeve, facing the background portion of the photoconductor 3Y. Due to the developing potential and the non-developing potential, the Y toner on the developing sleeve selectively moves to the electrostatic latent image formed on the photoconductor 3Y, thereby forming a visible image, known as a toner image.

Y toner in a Y toner bottle 103Y is supplied to the developing device 4Y using a toner supply device for Y as appropriate. Within the developing device 4Y is disposed a toner density sensor as a toner density sensor. The toner density sensor detects the magnetic permeability of the developer, which is generated by carriers, which are magnetic materials. A main controller to be described later controls the driving of the toner supply device for Y based on the comparison between a value output from the toner density sensor and a target value (a toner density target value) output from the toner density sensor, to set the toner density of the developer within a fixed range, e.g., from 4 wt % through 9 wt %. Similar toner supply control is performed in the developing devices 4M, 4C, and 4K.

Subsequently, the drum cleaning device 6Y removes toner remaining on the surface of the photoconductor 3Y with a cleaning blade, which is made of polyurethane, contacting the photoconductor 3Y. Alternatively, in some embodiments, another method is applied to remove toner remaining on the surface of the photoconductor 3Y. The drum cleaning device 6Y includes a rotatable fur brush to contact the photoconductor 3Y, in addition to the cleaning blade so as to enhance the cleaning performance. The fur brush scrapes lubricant from solid lubricant, crushing it into fine powder to apply the fine powder onto the surface of the photoconductor 3Y.

Above the photoconductor 3Y is disposed a discharge lamp that constitutes a portion of the image forming unit 2Y. The discharge lamp irradiates the surface of the photoconductor 3Y having passed through the drum cleaning device 6Y. The electrically discharged surface of the photoconductor 3Y is then uniformly charged by a charging device 5Y. The optical writing unit 1YM causes a laser beam to scan the uniformly charged surface of the photoconductor 3Y. It should be noted that the charging device 5Y is driven to rotate while receiving a charging bias supplied from a power source. Alternatively, in some embodiments, the scorotron method that performs the charging process in a non-contact manner is applied to charge the surface of the photoconductor 3Y.

The image forming units 2M, 2C, and 2K have the same configuration as the above-described configuration of the image forming unit 2Y.

A primary transfer unit 60 is disposed below the four image forming units 2Y, 2M, 2C, and 2K. In the primary transfer unit 60, an intermediate transfer belt 61 as an image bearer, which is extended taut over a plurality of rollers, is endlessly rotated in the counter-clockwise direction by one of the rollers, while contacting the photoconductors 3Y, 3M, 3C, and 3K. Accordingly, the intermediate transfer belt 61 contacts the photoconductors 3Y, 3M, 3C, and 3K to form primary transfer nips for yellow, magenta, cyan, and black.

Near the primary transfer nips for yellow, magenta, cyan, and black, primary transfer rollers 62Y, 62M, 62C, and 62K, which are disposed inside the loop of the intermediate transfer belt 61, press the intermediate transfer belt 61 toward the photoconductors 3Y, 3M, 3C, and 3K. A primary transfer power source applies a primary transfer bias to the primary transfer rollers 62Y, 62M, 62C, and 62K. Thus, at each of the primary transfer nips for yellow, magenta, cyan, and black is formed a secondary transfer electric field that electrostatically moves toner images from the photoconductors 3Y, 3M, 3C, and 3K toward the intermediate transfer belt 61 by electrostatic force.

When the intermediate transfer belt 61 sequentially passes the primary-transfer nips for yellow, magenta, cyan, and black accompanying the endless movement thereof, the Y, M, C, and K toner images on the photoconductors 3Y, 3M, 3C, and 3K are sequentially superimposed onto the intermediate transfer belt 61. Accordingly, the composite toner image, in which the toner images of yellow, magenta, cyan, and black are superimposed one atop the other, is formed on the surface of the intermediate transfer belt 61.

A secondary transfer unit 78 is disposed below the intermediate transfer belt 61 or outside the loop of the intermediate transfer belt 61. The secondary transfer unit 78 includes a secondary transfer belt 77 formed into an endless loop, a ground-driven roller 72, a driving roller, a secondary belt cleaner 76, and a toner adhesion amount sensor 64. The secondary transfer belt 77 is extended taut over the ground-driven roller 72 and the driving roller, endlessly rotating with the rotation of the driving roller, in the counter-clockwise direction.

The secondary transfer belt 77 of the secondary transfer unit 78 contacts a portion of the front surface or the image bearing surface of the intermediate transfer belt 61 wound around a secondary transfer bias roller 68, and rollers 63, 67, 69, and 71, thereby forming a secondary transfer nip therebetween. The ground-driven roller 72 disposed inside the loop of the secondary transfer belt 77 is grounded; whereas, a secondary transfer bias is applied to the secondary transfer bias roller 68 disposed inside the loop of the intermediate transfer belt 61 by a secondary transfer power source to be described below. Thus, a secondary transfer electrical field is generated in the secondary transfer nip.

The registration rollers 34 on the right side of the drawing sheet forward the recording sheet P clamped therebetween to the secondary transfer nip, so that the forwarded recording sheet P coincides with the four-color image on the intermediate transfer belt 61. In the secondary transfer nip, the four-color toner image is secondarily transferred from the intermediate transfer belt 61 onto the recording sheet P at a time and becomes a full-color image on white color of the recording sheet P.

After the intermediate transfer belt 61 passes through the secondary transfer nip, toner residues not having been transferred onto the recording medium P remain on the front surface of the intermediate transfer belt 61. A primary belt cleaning device 75 of a primary transfer unit 60 removes toner remaining on the intermediate transfer belt 61 after the secondary transfer process.

The recording sheet P having passed through the secondary transfer nip separates from the intermediate transfer belt 61 and the secondary transfer belt 77, arriving at the conveyor belt unit 35. In the conveyor belt unit 35, an endless looped conveyor belt 36 is extended taut over a driving roller 37 and the driven roller 38, endlessly rotating in the counter-clockwise direction with the rotation of the driving roller 37. The recording sheet P having passed through the secondary transfer nip is conveyed along the upper-side surface of the conveyor belt 36 which is endlessly rotating to a fixing device 40.

The recording sheet P bearing an unfixed toner image on the surface thereof is delivered to the fixing device 40 and interposed between an endlessly looped fixing belt and the pressure roller in the fixing device 40. Under heat and pressure, the toner adhered to the toner image is fixed to the recording medium P in the fixing nip.

The recording medium P has a first face and a second face. The recording sheet P has the first face having a toner image transferred from the intermediate transfer belt 61 at the secondary transfer nip and having the transferred image fixed at the fixing device 40. The recording sheet P having such a first face is then sent to the conveyance path switching device 50. The image forming apparatus of the present disclosure includes the conveyance path switching device 50, a retransmission path 54, a switchback path 55, and a post-switchback conveyance path 56, those constitute a retransmission unit. The conveyance path switching device 50 switches a conveyance path of the recording sheet P having passed through the fixing device 40, between the sheet ejection path 51 and the retransmission path 54.

In particular, in the case of a single-sided printing mode to form an image on the first face of the recording sheet P, the conveyance path switching device 50 switches the conveyance path of the recording sheet P to the sheet ejection path 51. With the sheet ejection path 51 selected, the recording sheet P having the first face with an image formed thereon is sent to the output roller pair 52 via the sheet ejection path 51, thus outputting to the output tray 53 outside the image forming apparatus. In the case of a double-sided printing mode to form an image on each of the first face and the second face of the recording sheet P, the conveyance path switching device 50 also switches the conveyance path of the recording sheet P having both faces with images fixed after passing through the fixing device 40, to the sheet ejection path 51. With the sheet ejection path 51 selected, the recording sheet P with both faces having images formed thereon is output to the output tray 53 outside the image forming apparatus.

However, in the case of the double-sided printing mode, the conveyance path switching device 50 switches the conveyance path of the recording medium P having the first face with an image fixed after passing through the fixing device 40, to the retransmission path 54. The retransmission path 54 continues to the switchback path 55. The recording sheet P having sent to the retransmission path 54 enters the switchback path 55. When the entirety of the recording sheet P advancing in a conveyance direction fully enters the switchback path 55, the conveyance direction of the recording sheet P is reversed, thereby moving the recording sheet P backward. The retransmission path 54 separates into the switchback path 55 and the post-switchback conveyance path 56. The recording sheet P moving backward enters the post-switchback conveyance path 56. In this case, the upper side and the lower side (the first face and the second face, in respective) of the recording sheet P are turned over. The recording sheet P having turned over is retransmitted to the secondary transfer nip via the post-switchback conveyance path 56 and the sheet feeding path 30. The recording sheet P has a first face and a second face. The recording sheet P has the first face having a toner image transferred from the intermediate transfer belt 61 at the secondary transfer nip and having the transferred image fixed at the fixing device 40. The recording sheet P having such a first face is then sent to the conveyance path switching device 50.

The intermediate transfer belt 61 includes a base layer and an elastic layer. The base layer formed into an endless looped belt is formed of a material having a high stiffness, but having some flexibility. The elastic layer disposed on the front surface of the base layer is formed of an elastic material with high elasticity. Particles are dispersed in the elastic layer. While a portion of the particles projects from the elastic layer, the particles are concentratedly arranged in a belt surface direction. With these particles, an uneven surface of the belt with multiple bumps is formed on the intermediate transfer belt 61.

Examples of materials for the base layer include, but are not limited to, a resin in which an electrical resistance adjusting material made of a filler or an additive is dispersed to adjust electrical resistance. Examples of the resin constituting the base layer include, but are not limited to, fluorine-based resins such as ethylene tetrafluoroethylene copolymers (ETFE) and polyvinylidene fluoride (PVDF) in terms of flame retardancy, and polyimide resins or polyamide-imide resins. In terms of mechanical strength (high elasticity) and heat resistance, specifically, polyimide resins or polyamide-imide resins are more preferable.

Examples of the electrical resistance adjusting materials dispersed in the resin include, but are not limited to, metal oxides, carbon blacks, ion conductive materials, and conductive polymers. Examples of metal oxides include, but are not limited to, zinc oxide, tin oxide, titanium oxide, zirconium oxide, aluminum oxide, and silicon oxide. In order to enhance dispersiveness, surface treatment may be applied to metal oxides in advance. Examples of carbon blacks include, but are not limited to, ketchen black, furnace black, acetylene black, thermal black, and gas black. Examples of ion conductive materials include, but are not limited to, tetraalkylammonium salt, trialkyl benzyl ammonium salt, alkylsulfonate, and alkylbenzene sulfonate. Examples of ion conductive materials include, but are not limited to, tetraalkylammonium salt, trialkyl benzyl ammonium salt, alkylsulfonate, alkylbenzene sulfonate, alkylsulfate, glycerol esters of fatty acid, sorbitan fatty acid ester, polyoxyethylene alkylamine, polyoxyethylene aliphatic alcohol ester, alkylbetaine, and lithium perchlorate. Two or more ion conductive materials can be mixed. It is to be noted that electrical resistance adjusting materials are not limited to the above-mentioned materials.

A dispersion auxiliary agent, a reinforcing material, a lubricating material, a heat conduction material, an antioxidant, and so forth may be added to a coating liquid which is a precursor for the base layer, as needed. The coating solution is a liquid resin before curing in which electrical resistance adjusting materials are dispersed. An amount of the electrical resistance adjusting materials to be dispersed in the base layer of a seamless belt, i.e., the intermediate transfer belt 61 is preferably in a range from $1\times10^{8}$ through $1\times10^{13}$ Ω/sq in surface resistivity, and in a range from $1\times10^{6}$ through $10^{12}$ Ω·cm in volume resistivity. In terms of mechanical strength, an amount of the electrical resistance adjusting material to be added is determined such that the formed film is not fragile and does not crack easily. Preferably, a coating liquid, in which a mixture of the resin component (for example, a polyimide resin precursor and a polyamide-imide resin precursor) and the electrical resistance adjusting material are adjusted properly, is used to manufacture a seamless belt (i.e., the intermediate transfer belt) in which the electrical characteristics (i.e., the surface resistivity and the volume resistivity) and the mechanical strength are well balanced. The content of the electrical resistance adjusting material in the coating liquid when using carbon black is in a range from 10% through 25% by weight or preferably, from 15% through 20% by weight relative to the solid content. The content of the electrical resistance adjusting material in the coating liquid when using metal oxides is approximately 150% by weight or more preferably, in a range from 10% through 30% by weight relative to the solid content. If the content of the electrical resistance adjusting material is less than the above-described respective range, a desired effect is not achieved. If the content of the electrical resistance adjusting material is greater than the above-described respective range, the mechanical strength of the intermediate transfer belt (seamless belt) 61 drops, which is undesirable in actual use.

The thickness of the base layer is not limited to a particular thickness and can be selected as needed. The thickness of the base layer is preferably in a range from 30 μm through 150 μm, more preferably in a range from 40 μm through 120 μm, even more preferably, in a range from 50 μm through 80 μm. The base layer having a thickness of less than 30 μm cracks and easily gets torn. The base layer having a thickness of greater than 150 μm cracks when it is bent. By contrast, if the thickness of the base layer is in the above-described respective range, the durability is enhanced.

In order to increase the stability of traveling of the intermediate transfer belt, preferably, the thickness of the base layer is uniform as much as possible. An adjustment method to adjust the thickness of the base layer is not limited to a particular method, and can be selected as needed. For example, the thickness of the base layer can be measured using a contact-type or an eddy-current thickness meter or a scanning electron microscope (SEM) which measures a cross-section of the film.

As described above, the elastic layer of the intermediate transfer belt 61 includes an uneven surface formed with the particles dispersed in the elastic layer. Examples of elastic materials for the elastic layer include, but are not limited to, generally-used resins, elastomers, and rubbers. Preferably, elastic materials having good elasticity, such as elastomer materials and rubber materials, are used. Examples of the elastomer materials include, but are not limited to, polyesters, polyamides, polyethers, polyurethanes, polyolefins, polystyrenes, polyacrylics, polydiens, silicone-modified polycarbonates, and thermoplastic elastomers such as fluorine-containing copolymers. Alternatively, thermoplastic elastomer, such as fluorine-based copolymer thermoplastic elastomer, may be employed. Examples of thermosetting resins include, but are not limited to, polyurethane resins, silicone-modified epoxy resins, and silicone modified acrylic resins. Examples of rubber materials include, but are not limited to isoprene rubbers, styrene rubbers, butadiene rubbers, nitrile rubbers, ethylene-propylene rubbers, butyl rubbers, silicone rubbers, chloroprene rubbers, and acrylic rubbers. Examples of rubber materials include, but are not limited to, chlorosulfonated polyethylenes, fluorocarbon rubbers, urethane rubbers, and hydrin rubbers. A material having desired characteristics can be selected from the above-described materials. In particular, in order to accommodate a recording sheet with an uneven surface, such as Leathac (registered trademark), soft materials are preferable. Because the particles are dispersed, thermosetting materials are more preferable than thermoplastic materials. The thermosetting materials have a good adhesion property relative to resin particles due to an effect of a functional group contributing to the curing reaction, thereby fixating reliably. For the same reason, vulcanized rubbers are also preferable.

In terms of ozone resistance, softness, adhesion properties relative to the particles, application of flame retardancy, environmental stability, and so forth, acrylic rubbers are most preferable among elastic materials for forming the elastic layer. Acrylic rubbers are not limited to a specific product. Commercially-available acrylic rubbers can be used. An acrylic rubber of carboxyl group crosslinking type is preferable since the acrylic rubber of the carboxyl group crosslinking type among other cross linking types (e.g., an epoxy group, an active chlorine group, and a carboxyl group) provides good rubber physical properties (specifically, the compression set) and good workability. Preferably, amine compounds are used as crosslinking agents for the acrylic rubber of the carboxyl group crosslinking type. More preferably, multivalent amine compounds are used. Examples of the amine compounds include, but are not limited to, aliphatic multivalent amine crosslinking agents and aromatic multivalent amine crosslinking agents. Furthermore, examples of the aliphatic multivalent amine crosslinking agents include, but are not limited to, hexamethylenediamine, hexamethylenediamine carbamate, and N,N'-dicinnamylidene-1,6-hexanediamine. Examples of the aromatic multivalent amine crosslinking agents include, but are not limited to, 4,4'-methylenedianiline, m-phenylenediamine, 4,4'-diaminodiphenyl ether, 3,4'-diaminodiphenyl ether, 4,4'-(m-phenylenediisopropylidene) dianiline, 4,4'-(p-phenylenediisopropylidene) dianiline, 2,2'-bis [4-(4-aminophenoxy)phenyl] propane, 4,4'-diaminobenzanilide, 4,4'-bis (4-aminophenoxy)biphenyl, m-xylylenediamine, p-xylylenediamine, 1,3,5-benzenetriamine, and 1,3,5-benzenetriaminomethyl.

The amount of the crosslinking agent is, preferably, in a range from 0.05 through 20 parts by weight, more preferably, from 0.1 through 5 parts by weight, relative to 100 parts by weight of the acrylic rubber. An insufficient amount of the crosslinking agent causes failure in crosslinking, hence complicating efforts to maintain the shape of crosslinked products. By contrast, too much crosslinking agent causes crosslinked products to be too stiff, hence degrading elasticity as a crosslinking rubber.

In order to enhance a cross-linking reaction, a crosslinking promoter may be mixed in the acrylic rubber employed for the elastic layer. The type of crosslinking promoter is not limited particularly. However, it is preferable that the crosslinking promoter can be used with the above-described multivalent amine crosslinking agents. Such crosslinking promoters include, but are not limited to, guanidino compounds, imidazole compounds, quaternary onium salts, tertiary phosphine compounds, and weak acid alkali metal salts. Examples of the guanidino compounds include, but are not limited to, 1,3-diphenylguanidine, and 1,3-di-o-tolylguanidine. Examples of the imidazole compounds include, but are not limited to, 2-methylimidazole and 2-phenylimidazole. Examples of the quaternary onium salts include, but are not limited to, tetra-n-butylammonium bromide and octadecyltri-n-butylammonium bromide. Examples of the multivalent tertiary amine compounds include, but are not limited to, triethylenediamine and 1,8-diazabicyclo[5.4.0] undec-7-ene (DBU). Examples of the tertiary phosphines include, but are not limited to, triphenylphosphine and tri(p-tolyl)phosphine. Examples of the weak acid alkali metal salts include, but are not limited to, phosphates such as sodium and potassium, inorganic weak acid salts such as carbonate or stearic acid salt, and organic weak acid salts such as lauric acid salt.

The amount of the crosslinking promoter is, preferably, in a range from 0.1 through 20 parts by weight, more preferably, from 0.3 through 10 parts by weight, relative to 100 parts by weight of the acrylic rubber. Too much crosslinking promoter causes undesirable acceleration of crosslinking during crosslinking, generation of bloom of the crosslinking promoter on the surface of crosslinked products, and hardening of the crosslinked products. By contrast, an insufficient amount of the crosslinking agent causes degradation of the tensile strength of the crosslinked products and a significant elongation change or a significant change in the tensile strength after heat load.

The acrylic rubber composition of the present disclosure can be prepared by an appropriate mixing procedure such as roll mixing, Banbury mixing, screw mixing, and solution mixing. The order in which the ingredients are mixed is not particularly limited. However, it is preferable that ingredients that are not easily reacted or decomposed when heated are first mixed thoroughly, and thereafter, ingredients that are easily reacted or decomposed when heated, such as a crosslinking agent, are mixed together in a short period of time at a temperature at which the crosslinking agent is neither reacted not decomposed.

When heated, the acrylic rubber serves as a crosslinked product. The heating temperature is preferably in a range of 130° C. through 220° C., more preferably, 140° C. through 200° C. The crosslinking time period is preferably in a range of 30 seconds through 5 hours. The heating methods can be chosen from those which are used for crosslinking rubber compositions, such as press heating, steam heating, oven heating, and hot-air heating. In order to reliably crosslink the inside of the crosslinked product, post crosslinking may be additionally carried out after crosslinking is carried out once. The post crosslinking time period varies depending on the heating method, the crosslinking temperature and the shape of crosslinked product, but is carried out preferably for 1 through 48 hours. The heating method and the heating temperature may be appropriately chosen. Electrical resistance adjusting agents for adjustment of electrical characteristics and flame retardants to achieve flame retardancy may be added to the selected materials. Furthermore, antioxidants, reinforcing agents, fillers, and crosslinking promoters may be added as needed. The electrical resistance adjusting agents to adjust electrical resistance can be selected from the above-described materials. However, since the carbon blacks and the metal oxides impair flexibility, it is preferable to minimize the amount of use. Ion conductive materials and conductive high polymers are also effective. Alternatively, these materials can be used in combination.

Preferably, various types of perchlorates and ionic liquids in an amount from about 0.01 parts by weight through 3 parts by weight are added, based on 100 parts by weight of rubber. With the ion conductive material in an amount 0.01 parts by weight or less, the resistivity cannot be reduced effectively. However, with the ion conductive material in an amount 3 parts by weight or more, it is highly possible that the conductive material blooms or bleeds to the belt surface.

The electrical resistance adjusting material to be added is in such an amount that the surface resistivity of the elastic layer is, preferably, in a range from $1\times10^{8}$ Ω/sq through $1\times10^{13}$ Ω/sq, and the volume resistivity of the elastic layer is, preferably, in a range from $1\times10^{6}$ Ω·cm through $1\times10^{12}$ Ω·cm. In order to obtain high toner transferability relative to an uneven surface of a recording sheet as is desired in image forming apparatuses using electrophotography in recent years, it is preferable to adjust a micro rubber hardness of the elastic layer to 35 or less under the condition 23° C., 50% RH. In measurement of Martens hardness and Vickers hardness, which are a so-called micro-hardness, a shallow area of a measurement target in a bulk direction, that is, the hardness of only a limited area near the surface is measured. Thus, deformation capability of the entire belt cannot be evaluated. Consequently, for example, in a case in which a soft material is used for the uppermost layer of the intermediate transfer belt 61 with a relatively low deformation capability as a whole, the micro-hardness decreases. In such a configuration, the intermediate transfer belt 61 with a low deformation capability does not conform to the surface condition of the uneven surface of the recording sheet, thereby impairing the desired transferability relative to the uneven surface of the recording sheet. In view of the above, preferably, the micro-rubber hardness, which allows the evaluation of the deformation capability of the entire intermediate transfer belt 61, is measured to evaluate the hardness of the intermediate transfer belt 61.

The layer thickness of the elastic layer is, preferably, in a range from 200 μm through 2 mm, more preferably, 400 μm through 1000 μm. The layer thickness less than 200 μm hinders deformation of the belt in accordance with the roughness (surface condition) of the recording sheet and a transfer-pressure reduction effect. By contrast, the layer thickness greater than 2 mm causes the elastic layer to sag easily due to its own weight, resulting in unstable movement of the intermediate transfer belt 61 and damage to the intermediate transfer belt 61 looped around rollers. The layer thickness can be measured by observing the cross-section of the elastic layer using a scanning electron microscope (SEM), for example.

The particle to be dispersed in the elastic material of the elastic layer is a spherical resin particle having an average particle diameter of equal to or less than 100 μm and are insoluble in an organic solvent. Furthermore, the 3% thermal decomposition temperature of these resin particles is equal to or greater than 200° C. The resin material of the particle is not particularly limited, but may include acrylic resins, melamine resins, polyamide resins, polyester resins, silicone resins, fluorocarbon resins, and rubbers. Alternatively, in some embodiments, surface processing with different material is applied to the surface of the particle made of resin materials. A surface of a spherical mother particle made of rubber may be coated with a hard resin. Furthermore, the mother particle may be hollow or porous.

Among such resins mentioned above, the silicone resin particles are most preferred because the silicone resin particles provide good slidability, separability relative to toner, and wear and abrasion resistance. Preferably, the spherical resin particles are prepared through a polymerization process. The more spherical the particle, the more preferred. Preferably, the volume average particle diameter of the particle is in a range from 1.0 μm through 5.0 μm, and the particle dispersion is monodisperse with a sharp distribution. The monodisperse particle is not a particle with a single particle diameter. The monodisperse particle is a particle having a sharp particle size distribution. More specifically, the distribution width of the particle is equal to or less than ±(Average particle diameter×0.5 μm). With the particle diameter of the particle less than 1.0 μm, enhancement of transfer performance by the particle cannot be sufficiently achieved. By contrast, with the particle diameter greater than 5.0 μm, the space between the particles increases, which results in an increase in the surface roughness of the intermediate transfer belt 61. In this configuration, toner is not transferred well, and the intermediate transfer belt 61 cannot be cleaned well. In general, the particle made of resin material has a relatively high insulation property. Thus, if the particle diameter is too large, accumulation of electrical charges of the particle diameter during continuous printing causes image defect easily.

Either commercially-available products or laboratory-derived products may be used as the particle. The thus-obtained particle is directly applied to the elastic layer and evened out, thereby evenly distributing the particle with ease. With this configuration, an overlap of the particles in the belt thickness direction is reduced, if not prevented entirely. Preferably, the cross-sectional diameter of the plurality of particles in the surface direction of the elastic layer is as uniform as possible. More specifically, the distribution width thereof is equal to or less than ±(Average particle diameter×0.5 μm). For this reason, preferably, powder including particles with a small particle diameter distribution is used as the particles. If the particles having a specific particle diameter can be applied to the elastic layer selectively, it is possible to use particles having a relatively large particle diameter distribution. It is to be noted that timing at which the particles are applied to the surface of the elastic layer is not particularly limited. The particles can be applied before or after crosslinking of the elastic material of the elastic layer.

Preferably, a projected area ratio of a portion of the elastic layer having the particles relative to the elastic layer with its surface being exposed is equal to or greater than 60% in the surface direction of the elastic layer. In a case in which the projected area ratio is less than 60%, the frequency of direct contact between toner and the pure surface of the elastic layer increases, thereby degrading transferability of toner, cleanability of the belt surface from which toner is removed, and filming resistance. In some embodiments, a belt without the particles dispersed in the elastic layer can be used as the intermediate transfer belt 61.

Figure 2:
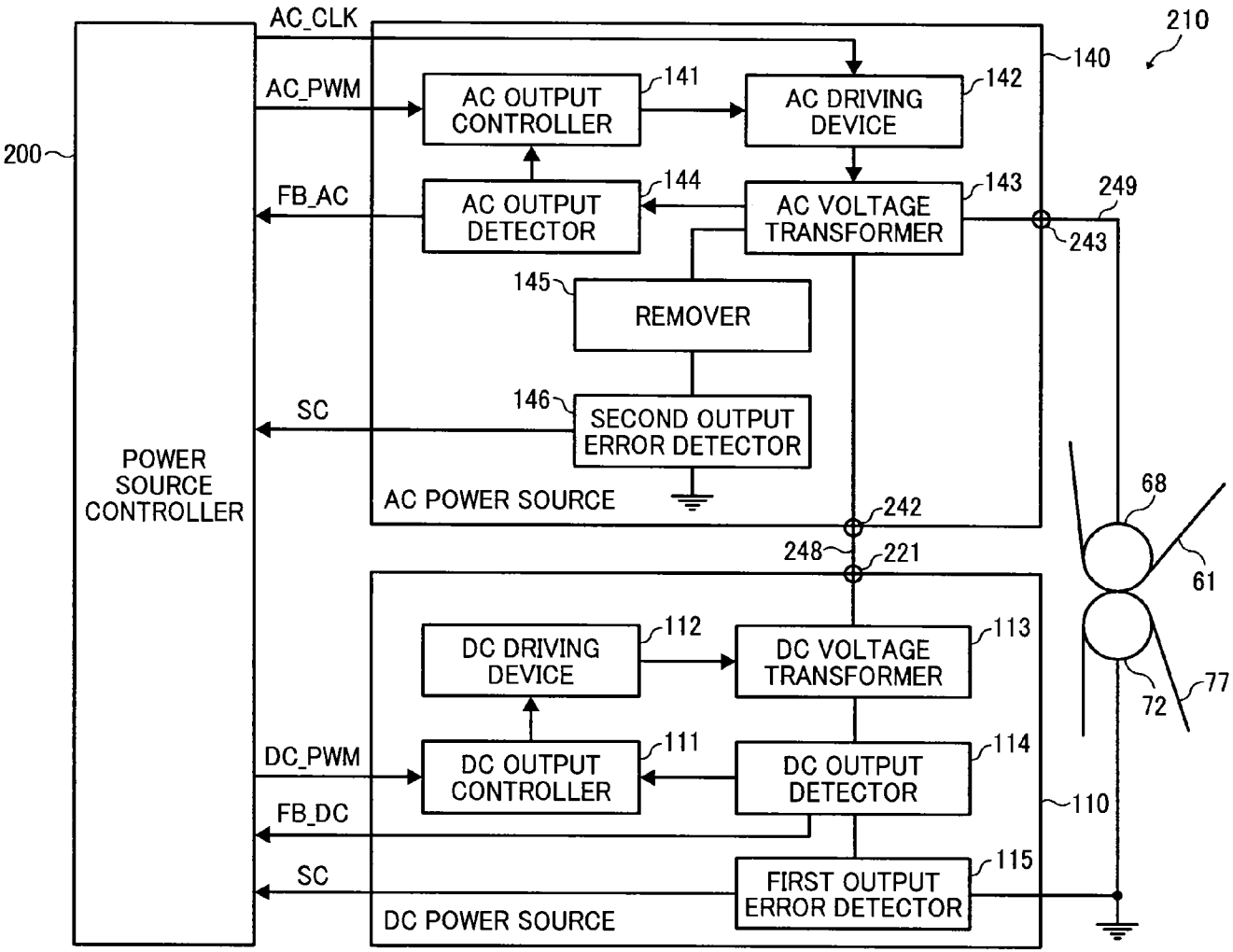
FIG. 2 is a block diagram of a portion of an electrical circuit of a secondary transfer power source employed in the image forming apparatus of FIG. 1 together with a secondary transfer bias roller, an intermediate transfer belt, a secondary transfer belt, and a ground-driven roller, according to an embodiment of the present disclosure.

FIG. 2 is a block diagram of a portion of an electrical circuit of a secondary transfer power source employed in the image forming apparatus of FIG. 1 together with a secondary transfer bias roller, an intermediate transfer belt, a secondary transfer belt, and a ground-driven roller, according to an embodiment of the present disclosure. As illustrated in FIG. 2, the secondary transfer power source 210 includes a direct-current (DC) power source 110 and an alternating current (AC) power source 140, a power source controller 200, and so forth. The AC power source 140 is detachably mountable relative to a body of the secondary transfer power source 210. The DC power source 110 outputs a DC voltage to apply an electrostatic force to toner on the intermediate transfer belt 61 so that the toner moves from the belt side to the recording sheet side in the secondary transfer nip. The DC power source 110 includes a DC output controller 111, a DC driving device 112, a DC voltage transformer 113, a DC output detector 114, a first output error detector 115, and an electrical connector 221.

The AC power source 140 outputs an alternating current voltage to be superimposed on the DC voltage. The AC power source 140 includes an AC output controller 141, an AC driving device 142, an AC voltage transformer 143, an AC output detector 144, a remover 145, a second output error detector 146, and electrical connectors 242 and 243.

The power source controller 200 controls the DC power source 110 and the AC power source 140, and is equipped with a central processing unit (CPU), a Read Only Memory (ROM), and a Random Access Memory (RAM). The power source controller 200 inputs a DC_PWM signal to the DC output controller 111. The DC_PWM signal controls an output level of the DC voltage. Furthermore, an output value of the DC voltage transformer 113 detected by the DC output detector 114 is provided to the DC output controller 111. Based on the duty ratio of the input DC_PWM signal and the output value of the DC voltage transformer 113, the DC output controller 111 controls the DC voltage transformer 113 via the DC driving device 112 to adjust the output value of the DC voltage transformer 113 to an output value instructed by the DC_PWM signal. The DC_PWM signal controls an output level of the DC voltage. Based on the duty ratio of the input DC_PWM signal and the output value of the DC voltage transformer 113, the DC output controller 111 controls the DC voltage transformer 113 via the DC driving device 112 to adjust the output value of the DC voltage transformer 113 to an output value instructed by the DC_PWM signal.

The DC driving device 112 drives the DC voltage transformer 113 in accordance with the instruction from the DC output controller 111. The DC driving device 112 drives the DC voltage transformer 113 to output a DC high voltage having a negative polarity. In a case in which the AC power source 140 is not connected, the electrical connector 221 and the secondary transfer bias roller 68 are electrically connected by a harness 249 so that the DC voltage transformer 113 outputs (applies) a DC voltage to the secondary transfer back surface roller 33 via the harness 249. In a case in which the AC power source 140 is connected, the electrical connector 221 and the electrical connector 242 are electrically connected by a harness 248 so that the DC voltage transformer 113 outputs a DC voltage to the AC power source 140 via the harness 248.

The DC output detector 114 detects and outputs an output value of the DC high voltage from the DC voltage transformer 113 to the DC output controller 111. The DC output detector 114 outputs the detected output value as a FB_DC signal (feedback signal) to the power source controller 200 to control the duty of the DC_PWM signal in the power source controller 200 so as not to impair transferability due to environment and load. According to the present illustrative embodiment, the AC power source 140 is detachably mountable relative to the main body of the secondary transfer power source 210. Thus, an impedance in the output path of the high voltage output is different between when the AC power source 140 is connected and when the AC power source 140 is not connected. Consequently, when the DC power source 110 outputs the DC voltage under constant voltage control, the impedance in the output path changes depending on the presence of the AC power source 140, thereby changing a division ratio. Furthermore, the high voltage to be applied to the secondary transfer bias roller 68 varies, causing the transferability to vary depending on the presence of the AC power source 140.

In view of the above, according to the present illustrative embodiment, the DC power source 110 outputs the DC voltage under constant current control, and the output voltage is changed depending on the presence of the AC power source 140. With this configuration, even when the impedance in the output path changes, the high voltage to be applied to the secondary transfer bias roller 68 is kept constant, thereby maintaining reliably the transferability irrespective of the presence of the AC power source 140. Furthermore, the AC power source 140 can be detached and attached without changing the DC_PWM signal value. According to the present illustrative embodiment, the DC power source 110 is under constant-current control. Alternatively, in some embodiments, the DC power source 110 can be under constant voltage control as long as the high voltage to be applied to the secondary transfer bias roller 68 is kept constant by changing the DC_PWM signal value upon detachment and attachment of the AC power source 140 or the like.

The first output error detector 115 is disposed on an output line of the DC power source 110. When an output error occurs due to a ground fault or other problems in an electrical system, the first output error detector 115 outputs an SC signal indicating the output error such as leakage to the power source controller 200. With this configuration, the power source controller 200 can stop the DC power source 110 to output the high voltage.

The power source controller 200 inputs an AC_PWM signal and an output value of the AC voltage transformer 143 detected by the AC output detector 144. The AC_PWM signal controls an output level of the AC voltage. Based on the duty ratio of the input AC_PWM signal and the output value of the AC voltage transformer 143, the AC output controller 141 controls the AC voltage transformer 143 via the AC driving device 142 to adjust the output value of the AC voltage transformer 143 to an output value instructed by the AC_PWM signal. The AC_PWM signal controls an output level of the AC voltage. Based on the duty ratio of the input AC_PWM signal and the output value of the AC voltage transformer 143, the AC output controller 141 controls the AC voltage transformer 143 via the AC driving device 142 to adjust the output value of the AC voltage transformer 143 to an output value instructed by the AC_PWM signal.

An AC_CLK signal to control the output frequency of the AC voltage is input to the AC driving device 142. The AC driving device 142 drives the AC voltage transformer 143 in accordance with the instruction from the AC output controller 141 and the AC_CLK signal. As the AC driving device 142 drives the AC voltage transformer 143 in accordance with the AC_CLK signal, the output waveform generated by the AC voltage transformer 143 is adjusted to a desired frequency instructed by the AC_CLK signal.

The AC driving device 142 drives the AC voltage transformer 143 to generate an AC voltage, and the AC voltage transformer 143 then generates a superimposed voltage in which the generated AC voltage and the DC high voltage output from the DC voltage transformer 113 are superimposed. In a case in which the AC power source 140 is connected, that is, the electrical connector 243 and the secondary transfer bias roller 68 are electrically connected by the harness 249, the AC voltage transformer 143 outputs (applies) the thus-obtained superimposed voltage to the secondary transfer bias roller 68 via the harness 249. In a case in which the AC voltage transformer 143 does not generate the AC voltage, the AC voltage transformer 143 outputs (applies) the DC high voltage output from the DC voltage transformer 113 to the secondary transfer bias roller 68 via the harness 249. Subsequently, the voltage (the superimposed voltage or the DC voltage) output to the secondary transfer bias roller 68 returns to the DC power source 110 via the intermediate transfer belt 61, the secondary transfer belt 77, and the ground-driven roller 72.

The AC output detector 144 detects and outputs an output value of the AC voltage from the AC voltage transformer 143 to the AC output controller 141. The AC output detector 144 outputs the detected output value as a FB_AC signal (feedback signal) to the power source controller 200 to control the duty of the AC_PWM signal in the power source controller 200 to prevent the transferability from dropping due to environment and load. The AC power source 140 carries out constant voltage control. Alternatively, in some embodiments, the AC power source 140 may carry out constant current control. The waveform of the AC voltage generated by the AC voltage transformer 143 (the AC voltage power source 140) is either a sine wave or a square wave. According to the present illustrative embodiment, the waveform of the AC voltage is a short-pulse square wave. The AC voltage having a short-pulse square wave can enhance image quality.

In the image forming apparatus according to the present disclosure, toner for the black color (K toner) contains carbon black. In a case of full-color mode to form toner images for other colors, in addition to a toner image for the black color, the secondary transfer bias, in which the AC voltage is superimposed on the DC voltage, is applied to the secondary transfer bias roller 68 as a transfer bias member. In the above-described configuration, the secondary transfer bias having a negative polarity, which is the same as that of toner, is applied to the secondary transfer bias roller 68, thereby electrostatically moving toner from the belt side to the recording sheet side within the secondary transfer nip.

In the image forming apparatus according to the present embodiment, the intermediate transfer belt 61 is a multi-layer belt having an elastic layer on the surface thereof, and a superimposed voltage is applied as the secondary transfer bias. Such an image forming apparatus has an advantage as described below: The toner image can be successfully transferred from the intermediate transfer belt 61 onto recessed portions of paper having an uneven surface, such as Japanese paper called "Washi".

In the image forming apparatus according to the present embodiment, a condition adjustment process is performed at a predetermined timing to stabilize image quality. In the condition adjustment process, a yellow test pattern image is formed on the photoconductor 3Y. In this case, the yellow test pattern image is constituted by a plurality of solid test toner images. In the same manner, a magenta test pattern image, a cyan test pattern image, and a black test pattern image are respectively formed on the photoconductors 3M, 3C, and 3K. A toner adhesion amount sensor detects an adhesion amount of toner in each solid test toner image corresponding to the test pattern image to adjust conditions for forming a toner image, such as conditions of a developing bias. In this case, the toner adhesion amount sensor includes an optical sensor.

Examples of a method for detecting a toner adhesion amount include a method for detecting a toner adhesion amount of a test toner image on the photoconductor 3 and a method for detecting a toner adhesion amount of a test toner image primarily transferred onto the intermediate transfer belt 61. In the case of the method for detecting a toner adhesion amount of the test toner image on the photoconductor 3, there is a need to dispose a toner adhesion amount sensor in the image forming unit for each color, resulting in a cost increase. In contrast, in the case of the method for detecting a toner adhesion amount of a test toner image primarily transferred onto the intermediate transfer belt 61, a toner adhesion amount sensor is used in common to detect toner adhesion amounts of toner images for a plurality of colors, which results in a cost reduction. However, in the image forming apparatus of the present disclosure with a configuration that employs the intermediate transfer belt 61 including an elastic layer on the base layer, it is difficult to precisely detect a toner adhesion amount by the method for detecting a toner adhesion amount of a test toner image primarily transferred onto the intermediate transfer belt 61. This is because, the front surface (image bearing surface) of the intermediate transfer belt 61 has a dark color toner.

Therefore, the image forming apparatus of the present disclosure employs a method for detecting a toner adhesion amount of a test toner image secondarily transferred from the intermediate transfer belt 61 onto the secondary transfer belt 77. In this case, the secondary transfer belt 77 has a bright color tone without an elastic layer. In particular, a toner adhesion amount sensor 64 as an optical sensor is disposed in the secondary transfer unit 78, to detect a toner adhesion amount of a test toner image on the secondary transfer belt 77.

Figure 3:
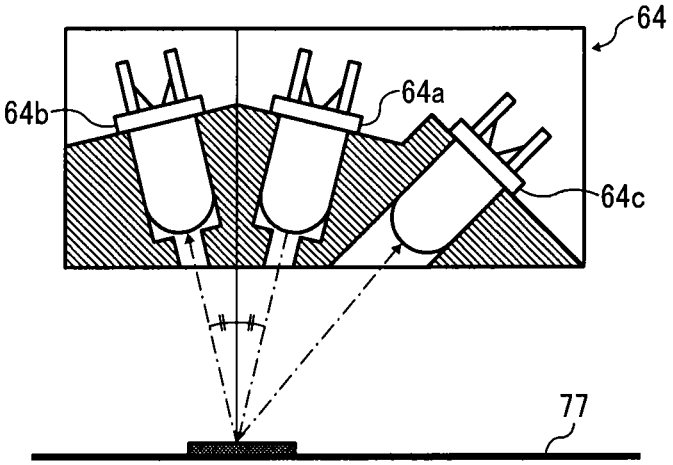
FIG. 3 is a schematic view of a toner adhesion amount sensor of the image forming apparatus according to an embodiment of the present disclosure.

FIG. 3 is a schematic view of the toner adhesion amount sensor 64. The toner adhesion amount sensor 64 includes a light emitting element 64*a*, a specular reflection light receiving element 64*b*, and a diffuse reflection light receiving element 64*c*. The specular reflection light receiving element 64*b* receives a specular reflection light spectrally reflected at the surface of the secondary transfer belt 77 or the toner image on the secondary transfer belt 77. The diffuse reflection light emitting element 64*c* receives a diffuse reflection light diffusely reflected on the above-described surface. The toner adhesion amount sensor 64 further includes a glass cap to transmit light, and a casing.

The light emitting element 64*a* constituted by a light emitting diode (LED) emits light toward the secondary transfer belt 77. The light beam (infrared light) passes through the glass cap to be reflected on the surface of the secondary transfer belt 77 or the surface of the toner image on the secondary transfer belt 77. The reflected light is transmitted through the glass cap of the toner adhesion amount sensor 64 again to enter the specular reflection light receiving element 64*b* or the diffuse reflection light receiving element 64*c*.

The light emitting element 64*a* may be constituted by a laser light emitting element, instead of the LED. The specular reflection light receiving element 64*b* receives specular reflection light of the reflected light to output voltage corresponding to the amount of the specular reflection light received. The specular reflection light receiving element 64*c* receives diffuse reflection light of the reflected light to output voltage corresponding to the amount of the diffuse reflection light received. The image forming apparatus of the present disclosure employs a GaAs infrared light emitting diode as the light emitting element 64*a*, to emit light having a peak wavelength of 950 nm. Further, the image forming apparatus of the present disclosure employs a Si photo transistor having a peak light receiving sensitivity of 800 nm as two light receiving elements. Alternatively, in some embodiments, the image forming apparatus of the present disclosure may employ a light receiving element including a photo diode and an amplifier circuit. The values of the peak wavelength of the emitted light and the peak light receiving sensitivity described above may be other values.

There is a distance (detection distance) of approximately 5 mm between the toner adhesion amount sensor 64 and the surface of the secondary transfer belt 77. The outputs from the two light receiving elements 64*b* and 64*c* of the toner adhesion amount sensor 64 are respectively converted into digital data by an Analog to Digital converter (A/D converter), and then input to a main controller to be described later.

Figure 4:
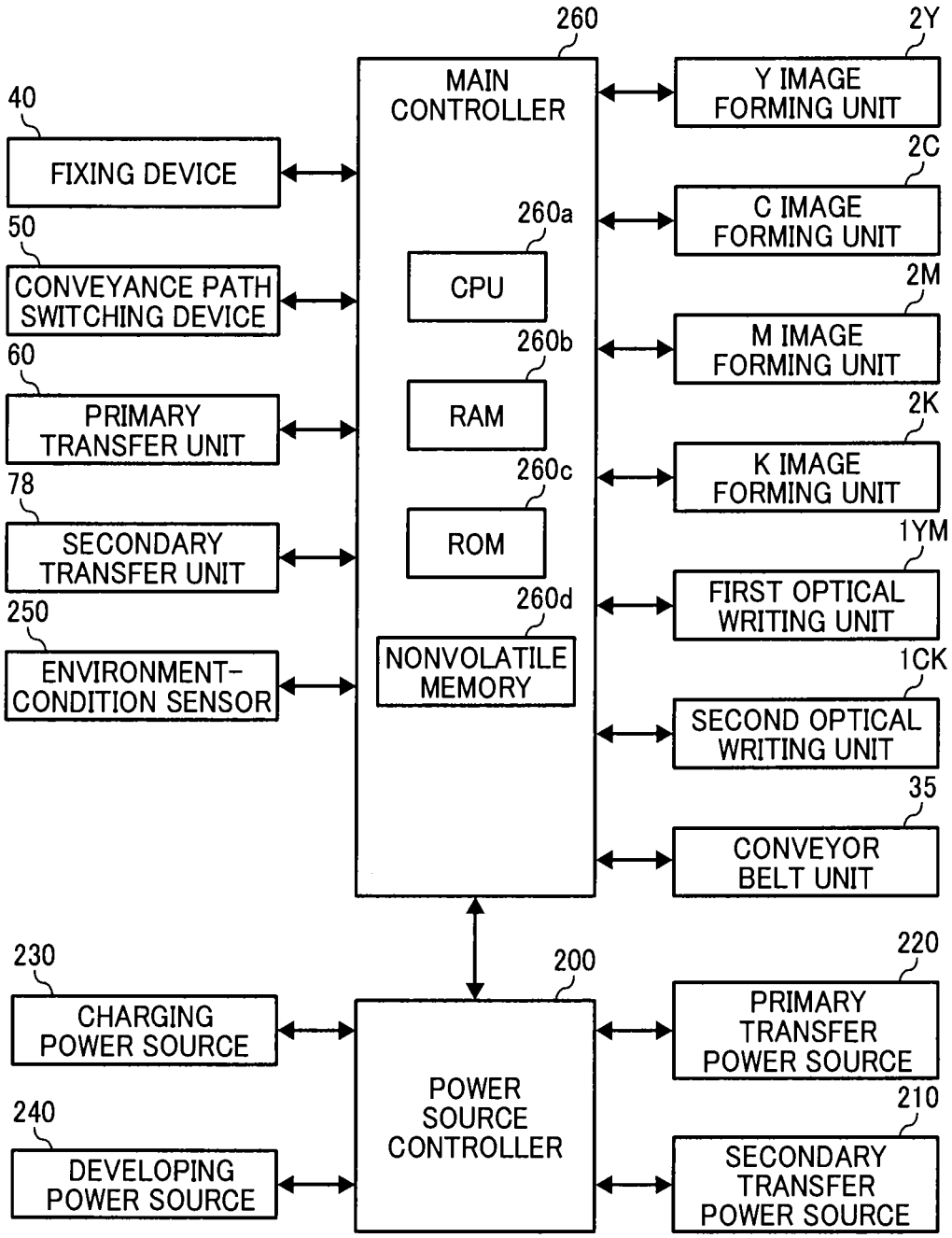
FIG. 4 is a block diagram of a portion of an electrical circuit of the image forming apparatus of FIG. 1 according to an embodiment of the present disclosure.

FIG. 4 is a block diagram of a portion of an electrical circuit of the image forming apparatus of the present disclosure. A main controller 260 is connected to image forming units 2Y, 2M, 2C, and 2K; optical writing units 1YM and 1CK; a conveyor belt unit 35; a fixing device 40; a conveyance path switching device 50; a primary transfer unit 60; a secondary transfer unit 78; a power source controller 200; an environment-condition sensor 250; and the like. It should be noted that the image forming units 2Y, 2M, 2C, and 2K respectively include surface potential sensors to detect the surface potentials of photoconductors 3Y, 3M, 3C, and 3K.

The power source controller 200 is connected to a primary transfer power source 220, a secondary transfer power source 210, a charging power source 230, a developing power source 240, and the like. The primary transfer power source 220 applies primary transfer bias to each of primary transfer rollers 62Y, 62M, 62C, and 62K. The power source controller 200 controls each of the outputs from the primary transfer power source 220. The charging power source 230 applies charging bias to each of charging devices 5Y, 5M, 5C, and 5K. The power source controller 200 controls each of the outputs from the primary transfer power source 220. The developing power source 240 outputs developing bias to each of developing sleeves for yellow, magenta, cyan, and black. The power source controller 200 controls each of the outputs from the developing power source 240.

The main controller 260 includes a central processing unit (CPU) 260*a*, a random access memory (RAM) 260*b*, a read only memory (ROM) 260*c*, and a nonvolatile memory 260*d*. The CPU 260*a* executes arithmetic processing and various programs. The main controller 260 performs a condition adjustment process at a predetermined timing when a main power source is turned ON, or when the image forming apparatus is waiting after a predetermined period of time elapses or after predetermined numbers of sheets or more are printed out. In particular, at such a predetermined timing, the photoconductors 3Y, 3M, 3C, and 3K are uniformly charged while rotating. In this case, the value of the charging bias is different from the constant value (for example, −700 V) used for the ordinary printing. The absolute value of the charging bias is increased, instead. The optical writing unit 1YM causes a laser beam to scan each of the photoconductors 3Y and 3M to form a plurality of electrostatic latent images having different potentials for the test toner images, on each of the photoconductors 3Y and 3M. The optical writing unit 1CK causes a laser beam to scan each of the photoconductors 3C and 3K to form a plurality of electrostatic latent images having different potentials for the test toner images, on each of the photoconductors 3C and 3K. The surface potential sensor detects the potentials of the electrostatic latent images, and then sequentially stores the detection results in the RAM 260*a*. Then, the developing devices 4Y, 4M, 4C, and 4K develop the electrostatic latent images into test pattern images for yellow, magenta, cyan, and black (hereinafter referred to as a Y test pattern image, an M test pattern image, a C test pattern image, and a K test pattern image, in respective), each including a plurality of test toner images having a different toner adhesion amount. During the developing process, the absolute value of the developing bias is gradually increased to be applied to each of the developing sleeves. Each of the developing bias and the charging bias consists of a direct current (DC) bias having a negative polarity.

The Y, M, C, and K test pattern images are primarily transferred onto the intermediate transfer belt 61 such that the test pattern images are arranged along a direction of movement of the intermediate transfer belt 61 without overlapping with each other. The primarily transferred test pattern images are then secondarily transferred onto the secondary transfer belt 77. When each of the test toner images of the test pattern images passes below the toner adhesion amount sensor 64, the toner adhesion amount sensor 64 outputs voltage corresponding to the toner adhesion amount of the test toner image. The output voltage of the toner adhesion amount sensor 64 is converted into voltage data. The main controller 260 stores the values of the toner adhesion amounts of the test toner images, which have been obtained based on the voltage data and a predetermined conversion algorithm, in a memory.

The test toner image after the toner adhesion amount thereof is detected is removed from the secondary transfer belt 77 by a secondary belt cleaner 76.

The main controller 260 calculates the linear approximation formula: $Y=a\times Vb+b$, which represents the relation of the toner adhesion amount and the developing potential (potential difference between the electrostatic latent image and the developing bias), by applying a least-squares method, based on the detected toner adhesion amounts stored in the RAM 260*a* and the detected potentials of the electrostatic latent images of the test toner images corresponding to the detected toner adhesion amounts. Based on the calculated linear approximation formula for each of yellow, magenta, cyan, and black, the values of the charging bias, and the developing bias, and the toner density target value of the developer (the target value output from the toner density sensor) are calculated to obtain a target toner adhesion amount. In the following print job, the values of the charging bias and the developing bias, and the toner density target value are set to the calculated values. Through the condition adjustment process as described above, the toner image forming conditions, such as the values of the charging bias and the developing bias, and the toner density target value, are separately adjusted for each of yellow, magenta, cyan, and black. A detailed description is provided in US20040253012, of a method for calculating a toner adhesion amount and a method for determining conditions therefore.

Next, a description is provided of a characteristic configuration of the image forming apparatus according to the present disclosure.

The image forming apparatus according to the present disclosure has a configuration that employs an intermediate transfer belt 61 having a multi-layer structure with an elastic layer on the surface thereof. The inventors of the present application have found that such a configuration may cause a secondary transfer failure depending on the environment conditions. In particular, the secondary transfer failure occurs when superimposed voltage as the secondary transfer bias is applied to the secondary transfer bias roller 68 under the environment conditions, such as low temperature or low humidity. Further, the secondary transfer failure also occurs when voltage including only a direct current voltage is applied as the secondary transfer bias to the secondary transfer bias roller 68 under the environment conditions other than the low temperature or low humidity.

The main controller 260 performs a bias switching process to switch the secondary transfer bias as needed, between the bias including the direct current voltage only and the bias including the superimposed voltage in response to the detected results of the environment-condition sensor 250, during a print job.

Figure 5:
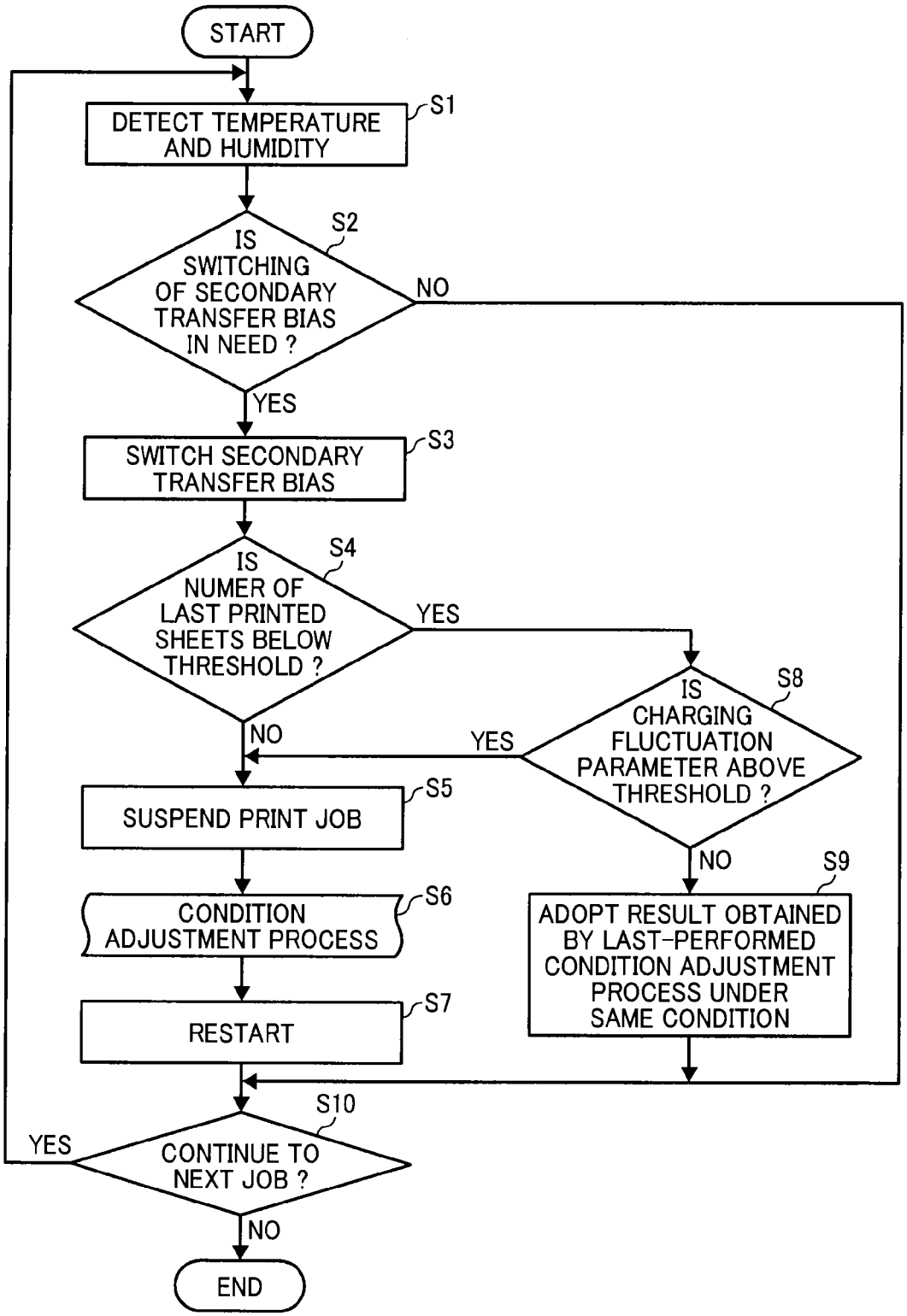
FIG. 5 is a flowchart of a bias-switching process and a condition adjustment process performed by a main controller of the image forming apparatus according to the embodiment of the present disclosure.

FIG. 5 is a flowchart of a bias-switching process and a condition adjustment process performed by a main controller 260. After the print job starts, the main controller 260 causes an environment-condition sensor 250 to detect the temperature and humidity (step 1). The term "step" is hereinafter referred to as "S". Then, the main controller 260 judges whether to switch the secondary transfer bias (S2) based on the detected results. In particular, the main controller 260 makes an affirmative judgment in the following cases: A case that the secondary transfer bias is the superimposed voltage and either of the detected temperature and humidity is low; and a case that the secondary transfer bias is a direct current (DC) voltage and neither of the detected temperature and humidity is low.

When the main controller 260 makes a negative judgment (NO) in S2, a print job is performed with the secondary transfer bias, which has been already set. Then, the main controller 260 judges whether there is a following print job to be performed. When an affirmative judgment is made (YES in S10), the process returns to S1 to detect temperature and humidity again. When a negative judgment is made (NO in S10), the main controller 260 completes a series of processing to stop print job.

In contrast, when the main controller 260 makes an affirmative judgment (YES) in S2, the secondary transfer bias is switched (S3). In particular, when either of the detected temperature and humidity is low and the secondary transfer bias is the superimposed voltage, the secondary transfer bias is switched from the superimposed voltage to the direct current voltage. In addition, when neither of the detected temperature and humidity is low and the secondary transfer bias is the direct current voltage, the secondary transfer bias is switched from the direct current voltage to the superimposed voltage. With this configuration in which the secondary transfer bias is switched according to the environment conditions to perform the secondary transfer, the secondary transfer failure due to fluctuation in the environment conditions is suppressed.

When the secondary transfer bias is switched, a great change occurs in the environment conditions after the last-performed condition adjustment process was performed. This may cause the toner image forming conditions, such as the value of the developing bias, to be unsuitable. Therefore, the main controller 260 suspends the print job to perform the condition adjustment process when a bias switching process is performed to switch the secondary transfer bias. However, in this case, if the secondary transfer failure occurs due to application of the secondary transfer bias unsuitable for the temperature and humidity, a significantly reduced amount of toner adhesion is detected for a test toner image for each color. In this case, the image-formation performance of the image forming unit is recognized to be lower than the original image-formation capability. As the developing bias, the charging bias, and the toner density target values are set according to the image forming performance, the image density in this case may be excessively increased. Therefore, the main controller 260 performs the condition adjustment process under the conditions for the secondary transfer bias having been switched when the bias switching process is performed to switch the secondary transfer bias.

In particular, after switching the secondary transfer bias according to the temperature and humidity in S3, the main controller 260 judges whether the number of the last printed sheets is below a threshold (S4). The number of the last printed sheets refers to the cumulative number of the printed sheets within a time period from the last-performed condition adjustment process with the applied secondary transfer bias having been switched to the present. When the number of the last printed sheets is relatively small and below the threshold, it means that the environment conditions rapidly changed for a temporary period of time, for some reasons and got back to the original environment conditions in a short time. In this case, the image-formation capability of the image forming unit is likely not to be much different from the image-formation capability of the image forming unit under the original environment conditions (the environment conditions prior to rapid change). However, in spite of the situation, if the print job is suspended to perform the condition adjustment process, downtime of the apparatus increases, thereby causing inconvenience to users. However, even when the number of the last printed sheets is below the threshold, there may be a possibility that the level of the developing bias is inappropriate when a charging fluctuation parameter exceeds the threshold. The charging fluctuation parameter represents a fluctuation amount of charge of toner within a time period from when the last-performed condition adjustment process was performed through the present.

Therefore, even after switching the secondary transfer bias in S3, the main controller 260 omits the condition adjustment process when the number of the last printed sheets is below the threshold (YES in S4) and the charging fluctuation parameter fails to exceed the threshold (NO in S8). In stead of the omitted condition adjustment process, the main controller 260 performs the subsequent print job for each of the colors yellow, magenta, cyan, and black, with the developing bias, the charging bias, and the toner density target value, those have been determined in the last-performed condition adjustment process with the switched secondary transfer bias applied (S9).

Therefore, in a case that the number of the last printed sheets is greater than or equal to the threshold (NO in S4), or in a case that the charging fluctuation parameter exceeds the threshold (YES in S8) even when the number of the last printed sheets is below the threshold, the print job is suspended (S5). Then, after performing the condition adjustment process with the switched secondary transfer bias applied (S6), the main controller 260 restarts the print job (S7). After that, with no following print job to be continued (NO in S3), the main controller 260 completes the print job.

In addition to when the secondary transfer bias is switched, the condition adjustment process may be performed under other conditions, such as when the main power source is turned on, and when the image forming apparatus is waiting after the predetermined number of sheets are printed out. The main controller 260 obtains the values of the temperature and humidity detected by the environment-condition sensor 250 prior to performing the condition adjustment process under the conditions other than the condition that the secondary transfer bias is switched in the bias switching process. In addition, the main controller 260 applies a secondary transfer bias suitable for the temperature and the humidity, choosing either one of the secondary transfer bias including the direct current voltage only and the secondary transfer bias including the superimposed voltage to perform the condition adjustment process.

The charging fluctuation parameters include five factors listed below: 1) the length of time that has elapsed after the last-performed condition adjustment process; 2) an amount of fluctuation in the temperature after the last-performed condition adjustment process; 3) an amount of fluctuation in the humidity after the last-performed condition adjustment process; 4) a difference (a variation amount of average image area ratio) between an average image area ratio of previous 50 printed sheets and an average image area ratio of further previous 50 printed sheets; and 5) a variation amount of a toner density target value after the last-performed condition adjustment process.

When the time period elapsed after the last-performed condition adjustment process exceeds the threshold specific thereto, there is a possibility that the amounts of charge of toner within developing devices 4Y, 4M, 4C, and 4K greatly vary after the last-performed condition adjustment process, which causes the developing bias to be unsuitable for the actual situation (1). In addition, when the amount of variation in the temperature after the last-performed condition adjustment process exceeds the threshold specific thereto, there is a possibility that the amounts of charge of toner within developing devices greatly fluctuate after the last-performed condition adjustment process, which causes the developing bias to be unsuitable for the actual situation (2). In addition, when the amount of variation in the humidity after the last-performed condition adjustment process exceeds the threshold specific thereto, there is a possibility that the amounts of charge of toner within developing devices greatly vary after the last-performed condition adjustment process, which causes the developing bias to be unsuitable for the actual situation (3). In addition, when a difference between an image area ratio of previous 50 printed sheets and an average image area ratio of further previous 50 printed sheets exceeds the threshold specific thereto, there is a possibility that the amounts of charge of toner within developing devices greatly fluctuate after the last-performed condition adjustment process, which causes the developing bias to be unsuitable for the actual situation (4). In addition, when a variation amount of a toner density target value after the last-performed condition adjustment process exceeds the threshold specific thereto, there is a possibility that the amounts of charge of toner within developing devices greatly fluctuate after the last-performed condition adjustment process, which causes the developing bias to be unsuitable for the actual situation (5). Therefore, when each of the charging fluctuation parameters exceeds the threshold specific to each charging fluctuation parameter, the condition adjustment process is performed.

It should be noted that the main controller 260 performs a correction process on a toner density target value during a continuous printing job to continuously form images on a plurality of recording sheets P. That is, the main controller 260 forms a test toner image on an inter-sheet region between a leading recording sheet P and a trailing recording sheet P over the circumferential surface of each of the photoconductors. Each of the formed test toner images is primarily transferred from the photoconductor to the intermediate transfer belt 61, and each of the primarily transferred test toner images is secondarily transferred from the intermediate transfer belt 61 onto the secondary transfer belt 77. The main controller 260 further detects a toner adhesion amount of each of the test toner images secondarily transferred on the secondary transfer belt 77. The main controller 260 then corrects the toner density target values based on the differences between the detected results and the target toner adhesion amounts to obtain a target image density. Such a correction process for the toner density target values is separately performed on each of the colors yellow, magenta, cyan, and black. With such a correction process for the toner density target values performed, the toner density target values may greatly fluctuate. In such a case, the amount of charge of toner is likely to greatly fluctuate as well.

The toner density target values are separately set for the respective developing devices 4Y, 4M, 4C, and 4K. When any one of the amounts of fluctuation of the toner density target values of the developing devices exceeds the threshold, the condition adjustment process is performed on all of the colors.

Figure 6:
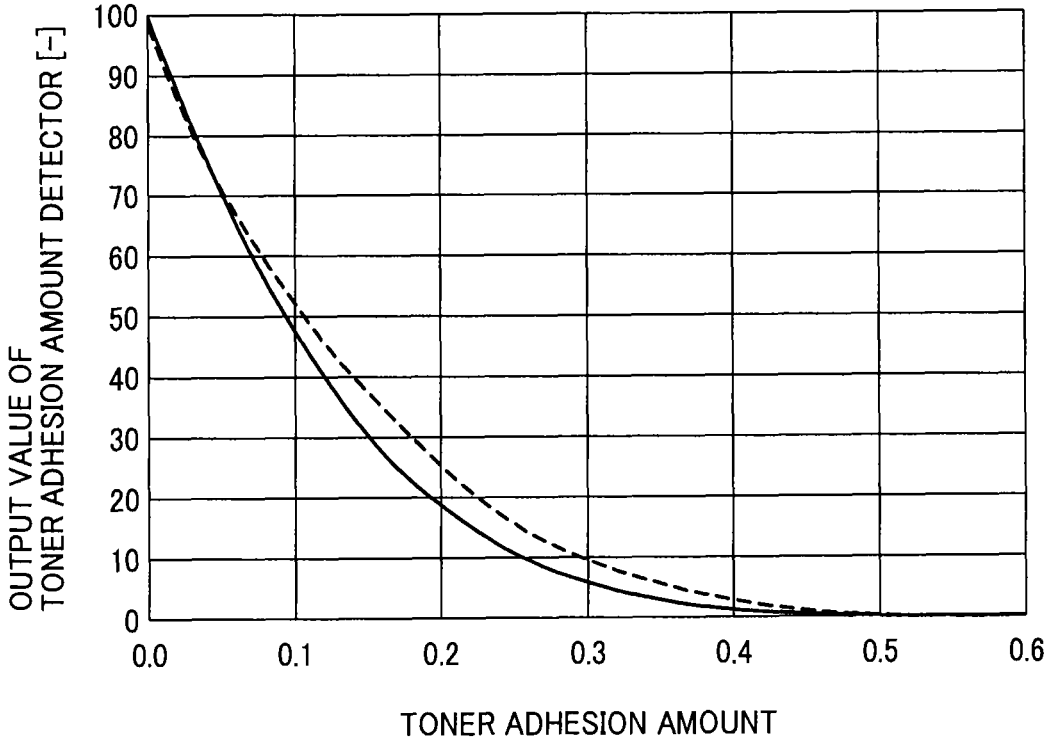
FIG. 6 is a graph chart of the relation between the output values of a toner adhesion amount sensor, toner adhesion amounts, and secondary transfer bias.

FIG. 6 is a graph chart of the relations among the output values of a toner adhesion amount sensor 64, toner adhesion amounts of the test toner images secondarily transferred onto the secondary transfer belt 77, and the type of the secondary transfer bias (the direct current voltage only and the superimposed voltage). In FIG. 6, a graph depicted by a dotted line and a graph depicted by a solid line show different types of the secondary transfer bias. As illustrated in FIG. 6, the relations between the outputs of the toner adhesion amount sensor 64 and the toner adhesion amounts on the secondary transfer belt 77 vary with type of the secondary transfer bias. As illustrated in FIG. 6, the surface state of each of the test toner images secondarily transferred onto the secondary transfer belt 77 changes with the type of the secondary transfer bias. In spite of the above, when the output of the toner adhesion amount sensor 64 is converted into a toner adhesion amount, using either one of the conversion algorithms, the main controller 260 fails to accurately read the toner adhesion amounts of the test toner images, resulting in a condition adjustment failure. In FIG. 6, the graph depicted by a dotted line shows the relations of the outputs of the toner adhesion amount sensor 64 and the toner adhesion amounts on the secondary transfer belt 77 with only the direct current voltage applied as the secondary transfer bias. The graph depicted by a solid line shows such relations with the superimposed voltage applied as the secondary transfer bias.

In view of the above, the main controller 260 stores two types of conversion algorithms (a first conversion algorithm and a second conversion algorithm) to convert the output of the toner adhesion amount sensor 64 into a toner adhesion amount, in a nonvolatile memory 260*d* as a memory. The two conversion algorithms includes a conversion algorithm (the first conversion algorithm) to convert an output value with the superimposed voltage applied as the secondary transfer bias, into a toner adhesion amount; and a conversion algorithm (the second conversion algorithm) to convert an output value with only the direct current voltage applied as the secondary transfer bias, into a toner adhesion amount. In the condition adjustment process, the main controller 260 reads the toner adhesion amount using the conversion algorithm corresponding to the secondary transfer bias having been switched in the last-performed bias switching process. Such a configuration prevents a condition adjustment failure, which is caused by converting the output of the toner adhesion amount sensor 64 into the toner adhesion amount, using the conversion algorithm unsuitable for the set secondary transfer bias.

Although the embodiment of the present disclosure has been described above, the present disclosure is not limited to the foregoing embodiments, but a variety of modifications can naturally be made within the scope of the present disclosure.

[Aspect A]

According to Aspect A, an image forming apparatus includes a toner image forming device (for example, image forming units 2Y, 2M, 2C, and 2K, and optical writing units 1YM and 1CK) configured to form a toner image on a surface of an image bearing belt (for example, an intermediate transfer belt 61) including multi layers; a transfer power source (for example, a secondary transfer power source 210) configured to output a transfer bias including a superimposed voltage, in which a direct current voltage is superimposed on an alternating current voltage to transfer the toner image from the image bearing belt onto a recording sheet P (recording medium) interposed between the image bearing belt and a nip forming device (for example, a secondary transfer belt 77); an environment-condition detector (for example, an environment-condition sensor 250) configured to detect an environment condition; and a controller (for example, a main controller 260) configured to control the transfer bias output from the transfer power source to perform a bias switching process to switch the transfer bias between the superimposed voltage and a direct current voltage based on a detected result of the environment-condition detector.

In the above-described condition, a secondary transfer bias is switched according to the detected results of the environment-condition device such that the superimposed voltage is applied as the transfer bias under the lower temperature and humidity, and the direct current voltage is applied as the transfer bias under the environment conditions except for the low temperature and humidity. With this configuration in which the secondary transfer bias is switched according to the environment conditions to perform the secondary transfer, the secondary transfer failure due to fluctuation in environment condition is suppressed.

[Aspect B]

According to B, the controller switches the transfer bias to the transfer bias including only the direct current voltage in the bias switching process when the detected result represents a low temperature or a low humidity, and controls the transfer bias including the superimposed voltage when the detected result does not represent the low temperature or the low humidity. With this configuration, a toner image is transferred using a transfer bias suitable for the environment conditions, irrespective of fluctuation in environment condition.

[Aspect C]

According to Aspect A or Aspect B, the image forming apparatus further includes a toner adhesion amount detector configured to detect a toner adhesion amount of a test toner image transferred onto a surface of the nip forming device. The controller performs a condition adjustment process to adjust a toner image forming condition of the toner image forming device based on the detected toner adhesion amount of the test toner image by the toner adhesion amount detector after the test toner image is transferred from the surface of the image bearing belt onto the surface of the nip forming device in response to a switch of the transfer bias in the bias switching process. In the condition adjustment process, the test toner image is transferred onto the nip forming device under a condition of the transfer bias having been switched by the bias switching process.

In the above-described configuration, the toner adhesion amount detector detects a toner adhesion amount of a test toner image transferred onto the surface of the nip forming device, thereby allowing an accurate detection of the toner adhesion amount of the test toner image on an image bearing belt of a multi-layer structure having a dark color tone. Further, when the toner image forming device varies the image-formation capability, for example when switching the transfer bias, a condition adjustment process is performed to prevent instability of image density due to variations in image formation density. Further, with the transfer bias having been switched in the last-performed bias switching process applied in the condition adjustment process, a condition adjustment failure, which is caused by performing the condition adjustment process with the transfer bias different from the transfer bias applied in the subsequent print job, is prevented.

[Aspect D]

According to Aspect C, the image forming apparatus further includes a data memory to store a first conversion algorithm corresponding to the transfer bias including the superimposed voltage and a second conversion algorithm corresponding to the transfer bias including the direct current voltage only, each conversion algorithm to convert an output from the toner adhesion amount detector into a toner adhesion amount. The controller obtains the toner adhesion amount in the condition adjustment process according to either one of the first conversion algorithm and the second conversion algorithm, corresponding to the transfer bias having been switched in a last bias switching process. Such a configuration prevents a condition adjustment failure, which is caused by converting an output of the toner adhesion amount detector into a toner adhesion amount, using the conversion algorithm corresponding to a transfer bias different from the transfer bias having been applied to the last bias switching process.

[Aspect E]

According to Aspect C or Aspect E, the controller performs the condition adjustment process with either one of the transfer bias including the superimposed voltage and the transfer bias including only the direct current voltage applied according to the detected result of the environment-condition detector, under a condition different from a condition that the transfer bias is switched in the bias switching process. With this configuration that performs the condition adjustment process under the conditions other than the condition that the secondary transfer bias is switched in the bias switching process, a condition adjustment failure due to application of the transfer bias unsuitable for the environment conditions.

[Aspect F]

According to any one of Aspect C through Aspect E, the controller omits the condition adjustment process to be performed in response to a switch of the transfer bias when a number of sheets having been printed with the transfer bias applied prior to the switching is less than or equal to a threshold of the number of sheets, even after the transfer bias is switched in the bias switching process. With this configuration, downtime of the apparatus, which is caused by performing the condition adjustment process when the image-formation capability of the toner image forming device does not greatly vary.

[Aspect G]

According to Aspect F, the controller adopts a toner image forming condition determined in a last-performed condition adjustment process having been performed with the transfer bias applied after the switch, to form a toner image, when the condition adjustment process in response to the switch of the transfer bias is omitted. This configuration prevents an image density failure, which is caused by applying the toner image forming condition corresponding to the transfer bias prior to a switch, even after the transfer bias is switched.

[Aspect H]

According to Aspect F or Aspect G, the controller performs the condition adjustment process when a charging fluctuation parameter representing a fluctuation amount of charge of toner used for forming a toner image is greater than or equal to a threshold of the charging fluctuation parameter, in cases that the transfer bias is switched in the bias switching process and that the number of sheets having been printed with the transfer bias applied prior to the switch is less than or equal to the threshold of the number of sheets. This configuration suppresses the image density failure, which is caused by failing to perform the condition adjustment process when the amount of charge of toner greatly fluctuates.

[Aspect I]

According to Aspect H, the controller adopts, as the charging fluctuation parameter, at least one of a length of time that has elapsed after the last-performed condition adjustment process, an amount of fluctuation in environment condition after the last-performed condition adjustment process, and an amount of fluctuation in average image area ratio. With this configuration, a great fluctuation in the amount of charge of toner is perceived based on the fact that the elapsed time, the amount of fluctuation in environment condition, or the amount of fluctuation in average image area ratio is greater than or equal to the threshold.

[Aspect J]

According to Aspect H, the toner image forming device includes a latent image bearer, a developing device to develop a latent image bore on the latent image bearer into a toner image, a primary transfer device to primarily transfer the toner image from the latent image bearer onto the image bearing belt, a toner density detector to detect a toner density of a developer within the developing device, and a toner supply device to supply the developing device with toner. The controller controls driving of the toner supply device based on a comparison between the detected result of the toner density detector and a toner density target value. The controller further corrects the toner density target value based on a detected toner adhesion amount of a test toner image formed at a predetermined timing. The controller also adopts, as the charging fluctuation parameter, an amount of variation in the toner density target value after the last-performed condition adjustment process. With this configuration, a great fluctuation in the amount of charge of toner is perceived based on the fact that the toner density target value is greater than or equal to the threshold.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an image bearing belt of a multi-layer structure;

a toner image forming device configured to form a toner image on a surface of the image bearing belt;

a nip forming device disposed in contact with the image bearing belt to form a transfer nip between the nip forming device and the image bearing belt;

a transfer power source configured to output a transfer bias including a superimposed voltage, in which a direct current voltage is superimposed on an alternating current voltage to transfer the toner image from the image bearing belt onto a recording medium at the transfer nip;

an environment-condition detector configured to detect an environment condition; and a controller configured to control the transfer bias output from the transfer power source to perform a bias switching process to switch the transfer bias between a transfer bias including the superimposed voltage and a transfer bias including only the direct current voltage based on a detected result of the environment-condition detector.

2. The image forming apparatus according to claim 1, wherein the controller is configured to switch the transfer bias to the transfer bias including only the direct current voltage in the bias switching process when the detected result represents a low temperature or a low humidity, and switch the transfer bias to the transfer bias including the superimposed voltage in the bias switching process when the detected result does not represent the low temperature or the low humidity.

3. The image forming apparatus according to claim 1, further comprising a toner adhesion amount detector configured to detect a toner adhesion amount of a test toner image transferred onto a surface of the nip forming device, wherein the controller is configured to perform a condition adjustment process to adjust a toner image forming condition of the toner image forming device based on the detected toner adhesion amount of the test toner image by the toner adhesion amount detector, after the test toner image is transferred from the surface of the image bearing belt onto the surface of the nip forming device in response to a switch of the transfer bias in the bias switching process, and wherein, in the condition adjustment process, the test toner image is transferred onto the nip forming device under a condition of the transfer bias having been switched by the bias switching process.

4. The image forming apparatus according to claim 3, further comprising a data memory to store a first conversion algorithm corresponding to the transfer bias including the superimposed voltage and a second conversion algorithm corresponding to the transfer bias including only the direct current voltage, each conversion algorithm to convert an output from the toner adhesion amount detector into a toner adhesion amount, wherein the controller is configured to obtain the toner adhesion amount in the condition adjustment process according to either one of the first conversion algorithm and the second conversion algorithm corresponding to the transfer bias having been switched in a last-performed bias switching process.

5. The image forming apparatus according to claim 3, wherein the controller is configured to perform the condition adjustment process with either one of the transfer bias including the superimposed voltage and the transfer bias including only the direct current voltage applied according to the detected result of the environment-condition detector, under a condition different from a condition that the transfer bias is switched in the bias switching process.

6. The image forming apparatus according to claim 3, wherein the controller is configured to omit the condition adjustment process to be performed in response to a switch of the transfer bias when a number of recording media having been printed with the transfer bias applied prior to the switch is less than or equal to a threshold of the number of recording media, even after the transfer bias is switched in the bias switching process.

7. The image forming apparatus according to claim 6, wherein the controller is configured to adopt a toner image forming condition determined in a last-performed condition adjustment process having been performed with the transfer bias applied after the switch, to form a toner image, when the condition adjustment process in response to the switch of the transfer bias is omitted.

8. The image forming apparatus of claim 6, wherein the controller is configured to perform the condition adjustment process when a charging fluctuation parameter representing a fluctuation amount of charge of toner used for forming a toner image is greater than or equal to a threshold of the charging fluctuation parameter, in cases that the transfer bias is switched in the bias switching process and that the number of recording media having been printed with the transfer bias applied prior to the switch is less than or equal to the threshold of the number of recording media.

9. The image forming apparatus according to claim 8, wherein the controller is configured to adopt, as the charging fluctuation parameter, at least one of a length of time that has elapsed after the last-performed condition adjustment process, an amount of fluctuation in environment condition after the last-performed condition adjustment process, and an amount of fluctuation in average image area ratio.

* * * * *